United States Patent [19]

Soini

[11] Patent Number: 4,602,563

[45] Date of Patent: Jul. 29, 1986

[54] OFF-SET PRINTING APPARATUS

[75] Inventor: Roland Soini, Hallein, Austria

[73] Assignee: Maier & Co., Hallein, Austria

[21] Appl. No.: 706,145

[22] Filed: Feb. 27, 1985

[30] Foreign Application Priority Data

Feb. 27, 1984 [DE] Fed. Rep. of Germany ..... 3407044
Oct. 9, 1984 [DE] Fed. Rep. of Germany ..... 3437035

[51] Int. Cl.[4] ..... B41F 3/42
[52] U.S. Cl. ..... 101/186; 101/252
[58] Field of Search ..... 101/252, 269, 282, 286, 101/146, 186

[56] References Cited

U.S. PATENT DOCUMENTS

| | | | |
|---|---|---|---|
| 783,188 | 2/1905 | Ford | 101/252 |
| 936,954 | 10/1909 | Sloane et al. | 101/252 |
| 1,814,806 | 7/1931 | Hormel | 101/252 |
| 1,866,910 | 7/1932 | Schmidt et al. | 101/252 |
| 2,147,653 | 2/1939 | King | 101/252 |
| 3,101,050 | 8/1963 | Schaefer et al. | 101/252 |
| 3,253,541 | 5/1966 | Goodrich | 101/269 |
| 3,532,053 | 10/1970 | Lieberman | 101/252 X |

*Primary Examiner*—J. Reed Fisher
*Attorney, Agent, or Firm*—McCormick, Paulding & Huber

[57] ABSTRACT

In an off-set printing device suited to multi-colored printing the printing plate support and the printing carrier support are arranged on a common carrier plate between two parallel racks connected with the carrier plate and extending in the printing direction. The printing roller is freely removable from the carrier plate and has at each of its axial ends a spur gear or pinion for engagement with an associated one of the racks, and the roll of the printing roller is freely rotatable relative to a shaft provided with hand grips. On the carrier plate—in the printing direction—in front of the printing plate support and on the printing roller at least one projection and a complementary recess are provided which in the presenting of the printing roller to the carrier plate engage with one another.

11 Claims, 13 Drawing Figures

OFF-SET PRINTING APPARATUS

The invention concerns a printing apparatus including a printing roller covered with a rubber blanket, a flat printing plate support, means for holding the printing plate to the printing plate support, a printing carrier support located behind the printing plate support in the movement direction of the printing roller (the printing direction), means for holding the printing carrier to the printing carrier support and orienting stops for orienting the printing plate and the printing carrier on their associated supports.

Customary printing apparatus with which multi-colored printing is possible are very expensive in construction and therefore costly so that such printing apparatuses come into question only for professional purposes and hardly are available to the hobby field.

The invention has as its object the provision of a printing apparatus of the foregoing type which on one hand provides a good quality print even in the case of multi-colored printing, and which on the other hand is simple in construction and manipulation and can be made at a low price, so that it can also be used for printing by young persons and hobbyists.

This problem is solved in accordance with the invention in that the printing plate support and the printing carrier support are arranged on a common carrier plate between two racks extending parallel to the printing direction and connected to the carrier plate, in that the printing roller is freely removable from the carrier plate and on each of its axial ends has a pinion for engagement with an associated one of the racks and is freely rotatable on a shaft provided with hand grips, and in that on the carrier plate in front of the printing plate support, in the printing direction, and on the printing roller is provided at least one projection and one complementary recess which engage one another in the starting position of the printing roller. Since in a non-professional printing apparatus the inking of the printing plate can be done by hand and since by proper choice of the printing plates a repeated moistening of the printing plates can be avoided, the otherwise usual inking mechanism and dampening mechanism can be omitted in the printing apparatus of the invention. Since the printing roller is freely removable from the carrier plate a complicated and expensive support of the printing roller on a carriage movable relative to the carrier plate is avoided. Decidedly, for a good print quality the printing apparatus of the invention provides that the printing roller without great effort can repeatedly be brought back to exactly its starting position so that even in the case of running the printing roller several times over the printing plate the picture on the rubber blanket of the printing roller is not displaced and made unsharp. By the arrangement on the carrier plate or on the printing roller of a projection and of a complementary recess on the other part the printing roller, after being lifted from the racks, can be quickly and without effort returned exactly to its starting position.

In an especially simply manufactured embodiment the printing plate support, the printing plate carrier support and the racks are made of one piece with the carrier plate with the entire arrangment preferably being made of plastic.

More versatile is an embodiment in which the printing plate support and the printing carrier support are formed as plates removable from the carrier plate with the carrier plate and/or the removable plates being provided with means for positioning the removable plates on the carrier plate. While the printing apparatus with the plates inserted can be used purely as an off-set printing apparatus, the user after removing the printing plate support can, for example, place a linoleum cut or a copper plate for an etching on the carrier plate support whereby he can print directly (reverse image printing) or indirectly (nonreversed image printing). Also, the user after removing the printing carrier plate can insert printing carrier with larger thicknesses than paper.

According to a preferred embodiment the projection is formed by a centering bar on the carrier plate extending perpendicular to the printing direction and the recess is formed by a centering groove on the circumference of the printing roller having a cross section at least nearly complementary to that of the projection and extending parallel to the axis of the roller. In this case the centering bar preferably has a substantially triangular cross sectional profile with a flat base for support from the carrier plate and two convexly curved flanks. This shape of the centering bar serves to center the printing roller even when it is inexactly set onto the centering bar and also allows the printing roller to be rolled away from its starting position without hinderance and vibration.

In an especially preferred embodiment the centering bar of the carrier plate is removable and is fixedly fastenable to the carrier plate by means of at least two pins. This has the advantage that the centering bar can serve at the same time as a holder and as an orientating stop for the printing plate, in that the pins pass through corresponding holes in the printing plate and thereby clamp the printing plate between the clamping bar and the carrier plate. With respect to the use of the printing apparatus of the invention for hobby printing it is especially convenient if the diameter and the spacing of the pins correspond to the corresponding measurements of the customary punches used for office purposes. Such a punch is found in practically every household or can be acquired for little money. The punching of the printing plate with such a punch guarantees an absolutely secure holding and an accurate orientation of the printing plate on the printing plate support.

For holding the printing carrier, for example a paper sheet, on the printing carrier support preferably a clamping bar is arranged between the printing plate support and the printing carrier support which clamping bar extends perpendicular to the printing direction and which clamping bar is pivotably supported on the carrier plate for movement about an axis perpendicular to the printing direction and biased toward its clamping position. The clamping bar at the same time serves as a stop for orienting the printing carrier in the printing direction. In connection with this it is also desirable if a stop is provided for arranging the printing carrier perpendicular to the printing direction, the latter stop being formed as a small projection from the printing carrier support. To prevent the clamping bar from interfering with the printing process, in the printing apparatus of the invention the spacing in the printing direction between the clamping bar and the centering bar is the same as the circumference of the printing roller with the width as measured in the printing direction of the section of the clamping bar which extends beyond the printing carrier support being less than the width of the centering groove in the printing roller. This has the result that the centering groove will be exactly positioned over the clamping bar when the printing roller starting from its correct starting position reaches the clamping bar—that is at the beginning of the printing carrier support.

An axial positioning of the printing roller and the positioning of it perpendicular to the printing direction is achieved in the simplest way in that the printing roller has at the inboard side of each of its pinions a guide flange extending radially outwardly beyond the pinion.

In accordance with a preferred embodiment the hand grips on the axial ends of the roller shaft have a larger diameter than the guide flanges, this being the case only for relatively small diameter rolls. For one thing these hand grips fit well in the hands when the printing roller is moved over the printing plate support and the printing carrier support with a definite pressure. On the other hand, with this arrangement the printing roller can be laid on a desired surface without the danger that the surface will be dirtied by ink from the rubber blanket or that the print on the printing roller will be injured. Means can be provided on the circumference of the hand grips for preventing the printing roller from rolling off the supporting surface. This can be achieved in the easiest way by providing at least one flat surface extending parallel to the axis of the roller on each hand grip the radial spacing of which surface from the roller axis is larger than the radius of the guide flanges. This also has the advantage that the roller can be laid on a supporting surface and, for example in the cleaning of the rubber blanket, can be turned while the hand grips remain at rest on the supporting surface.

Perferably the movement path of the printing roller in the printing direction is upwardly inclined at least at the end sections of the racks which extend beyond the printing carrier support. This can, for example, be achieved by diminishing the depth of the teeth of the racks at the ends of the racks.

Conveniently the crown diameter of the pinions is slightly larger than the outer diameter of the printing roller as covered with the rubber blanket. This has the effect that because of the difference in the radii of the pinions and the outer surface of the rubber blanket, and their thereupon dependant different tangential speeds, the printing carrier is tensioned in the printing direction so that the printing carrier has to be clamped only at one end, and a somewhat wavy printing carrier will be smoothed during a printing process.

Further featrues and advantages of the invention will be evident from the following description which in association with the accompanying drawings explains the invention in connection with exemplary embodiments.

The drawings are:

Figure 1:
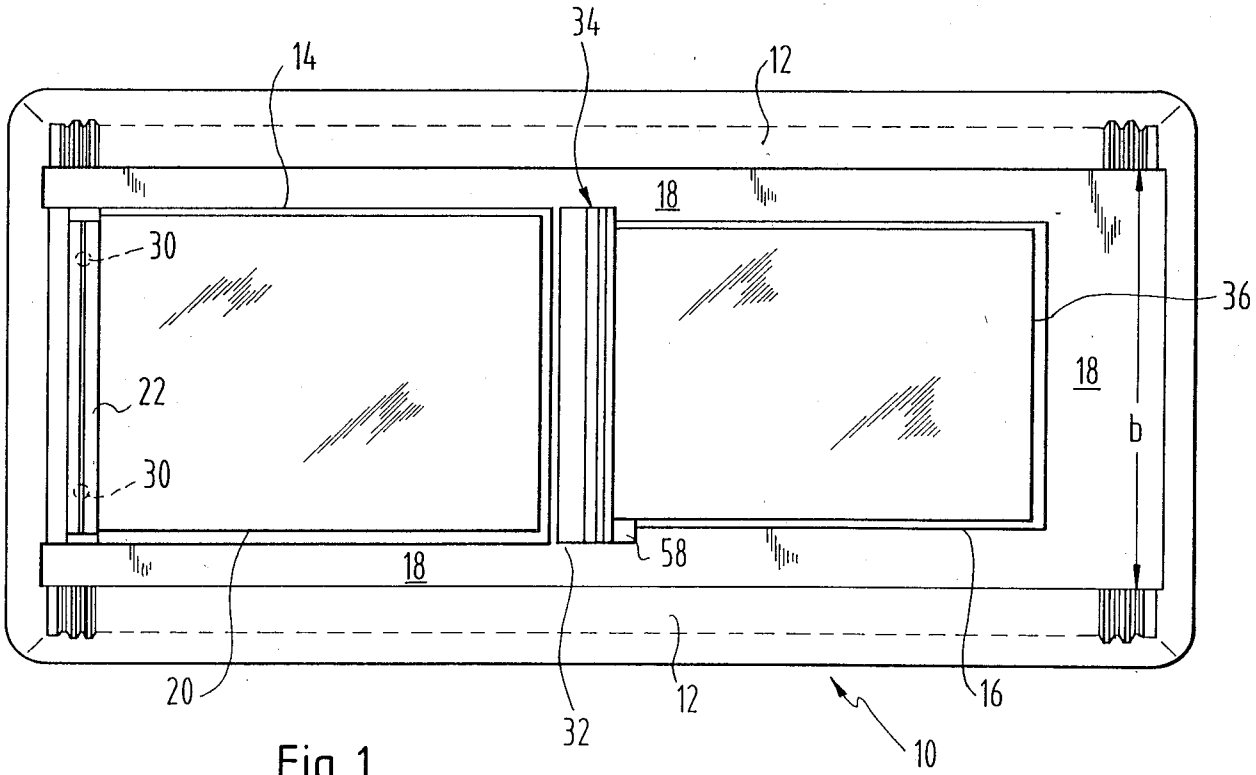
FIG. 1 is a plan view of a carrier plate with printing plate and printing carrier supports.

FIG. 1 shows a rectangular carrier plate, indicated generally at 10, which on its upper side has a rack 12 extending along each of its longitudinal edges. Between the racks 12 are, in the form of plate shaped projections with upper surfaces at the same elevation, a rectangular printing plate support 14 and a likewise rectangular printing carrier support 16 arrranged behind one another as viewed in the longitudinal direction of the racks 12. The supports or tables 14 and 16 are separated from the racks 12 and the end edges of the carrier plate 10 by recessed areas 18. The carrier plate 10, the racks 12, the printing plate support 14 and the printing carrier support 16 are made in one piece as an injection molded part.

Figure 4:
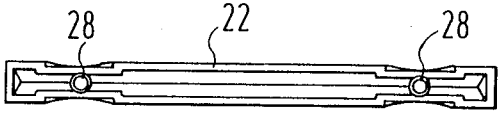
FIG. 4 is a bottom view of the centering strip of FIG. 3.
Figure 3:
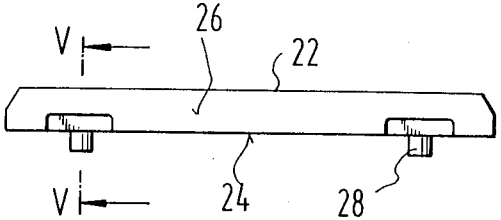
FIG. 3 is a side view of the centering strip.
Figure 5:
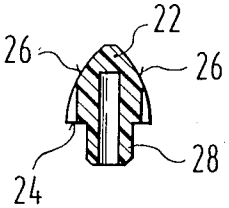
FIG. 5 is a sectional view along the line V—V of FIG. 3.

On the left end of the printing plate support 14, as seen in FIG. 1, a printing plate 20 lying on the support is held to the support by means of a centering bar arranged perpendicular to the racks 12, which centering bar is shown in more detail in FIGS. 3 through 5. The centering bar consists of a hollow or filled plastic part which according to FIG. 5 has a substantially triangular cross section with a flat base surface 24 and convexly curved side faces or flanks 26. The apex between the two convexly curved side faces 26 can, as shown in FIG. 5, be slightly flattened. On its base surface 24 the centering bar 22 has two pins 28 suited for insertion into non-illustrated complementary bores 30 in the left edge of the printing plate support 14. The diameter and the spacing of the pins 28 are so chosen that they correspond to the measurements of a conventional office punch. Therefore, it is possible to punch the printing plate 20 with such a punch and, with the help of the centering bar 22 and the pins 28, to hold it fixed relative to the printing plate support 14 not only immovably but also in a given position relative to the printing plate support. This punching can also be used for the preparation of a set of printing plates for a multi-colored print, to achieve a constant placement of the subject on the printing plates, so that these after mounting to the printing plate support 14 produce exactly registered prints.

Figure 9:
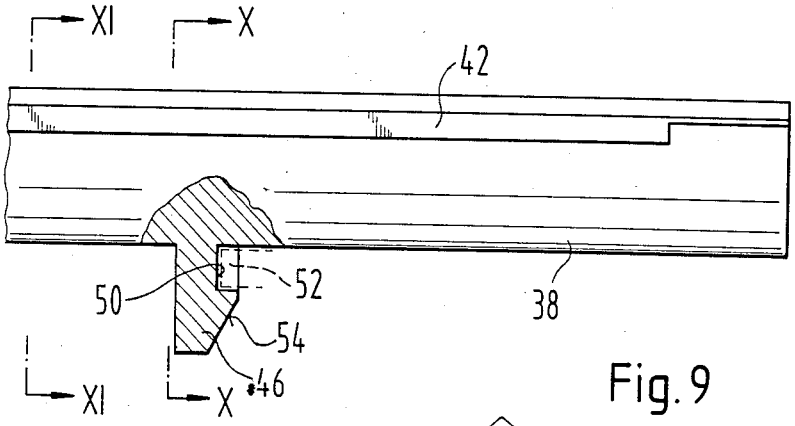
FIG. 9 is an enlarged partially cut away front view of one-half of the clamping bar.
Figure 10:
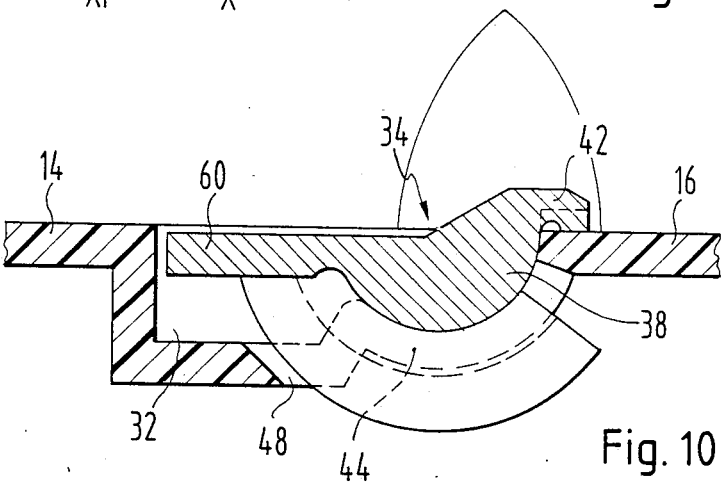
FIG. 10 is a sectional view through the clamping bar taken along the line X—X of FIG. 9, the clamping bar being shown assembled with the carrier plate.
Figure 11:
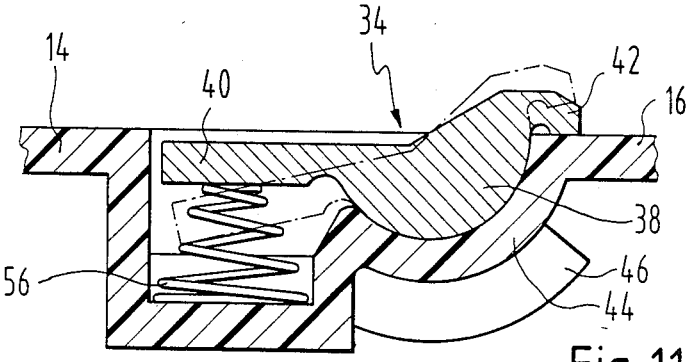
FIG. 11 is a sectional view corresponding to FIG. 10 and taken along the line XI—XI of FIG. 9.

In a recess 32 between the printing plate support 14 and the printing carrier support 16 is a clamping bar 34, which is shown in more detail in FIGS. 9 through 11 and which serves to hold stationary the printing carrier 36, in most cases a piece of paper, on the printing carrier support 16.

The clamping bar 34 consists of a nearly half cylindrical middle section 38 which along one of its longitudinal edges is provided with an operating strip 40 and along its other longitudinal edge is provided with a claw 42. The clamping bar 34 is supported by its middle section 38 in an arcuately curved trough 44 of the recess 32 between the printing plate support 14 and the printing carrier support 16, so that by pressing the operating strip 40 the clamping bar is pivotably movable about the axis of the half cylinder between a clamping position shown in FIG. 11 by the solid lines and a releasing position shown in FIG. 11 by the broken lines.

The clamping bar 34 is held to the carrier plate 10 by means of circular sector shaped flanges 46 (FIG. 9) which extend from the half cylindrical middle section 38 and are insertable in slots 48 formed in the carrier plate 10 in the area of the recess 32. Each flange 46 has on its outboard face an arcuate groove 50 in which an arcuately curved slot edge 52 is received, as indicated by the broken lines in FIG. 9. The arcuately curved slot edge 42 is formed by the slot 48 passing through the trough 44. The slot 48 is somewhat smaller than the flange 46, and the flange is provided with an installing face 54 so that the flange 46, by using a plastic material for the manufacture of the carrier plate having at least a slight amount of elasticisity, is installable by pressing it into the carrier plate, the slot edge 52 after the complete insertion of the flange 46 being captured in the arcuate groove 50. Thus, the clamping bar 34 is pivotably yet securely held to the carrier plate. To bias the clamping bar 34 toward its clamping position, at least one helical spring 56 is arranged between the bottom of the recess 32 and the operating strip 40, as seen in FIG. 11.

The clamping bar 34 along with its clamping function also has the function of a positioning device which determines the position of the printing carrier on the printing carrier support 16 in the longitudinal direction of the racks 12. In order to orient the printing carrier 36 transverely to the longitudinal direction of the racks 12 a stop in the form of a projection 58 is formed on at least one side of the printing carrier support 16 and against which projection the printing carrier 36 may be placed (FIG. 1).

Figure 6:
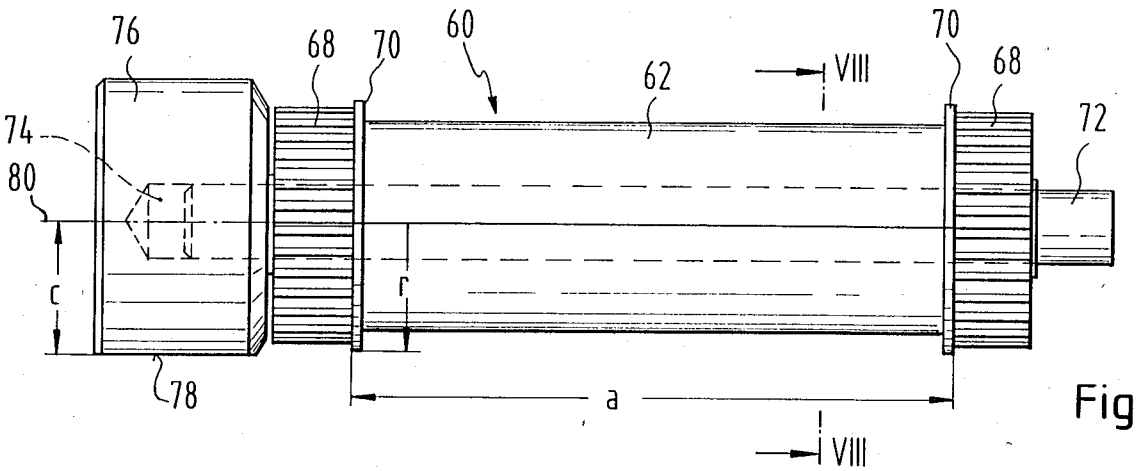
FIG. 6 is a side view of the printing roller of the invention, with only one hand grip being shown.
Figure 8:
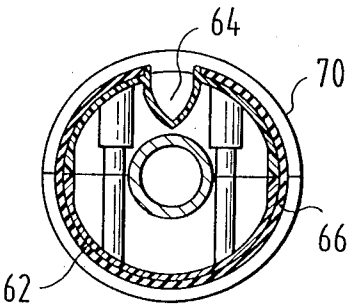
FIG. 8 is a sectional view through the printing roller taken along the line VIII—VIII of FIG. 6.
Figure 7:
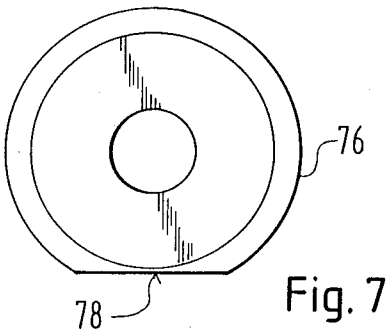
FIG. 7 is a view looking in the axial direction of the printing roller of the surface of a hand grip facing away from the roller.

FIGS. 6 through 8 show the impression or printing roller generally at 60. It includes a cylindrical roll body 62 consisting of two plastic half shells connected to one another by means of screws or the like (FIG. 8). The roll body 62 has a centering groove 64 arranged parallel to its axis and extending inwardly from its circumferential surface, the cross sectional profile of the groove being at least nearly complementery to the cross sectional profile of the centering bar 22. The roll body 64 is covered with a rubber blanket 66 which extends from one edge of the groove over the circumference of the roll body 62 to the other edge of the groove 64. The rubber blanket 66 can be fastened to the roll body in any desired way. Since with some degree of careful cleaning of the rubber blanket it can be used for many printing runs it may, for example, be glued to the roll body 62.

On each of its axial ends the roll body has a spur gear or pinion 68 which is bordered at its inner side by a guide flange 70 extending radially outwardly from it. The crown circle diameter of the pinion 68 is slightly larger than the diameter of the roll body 62 as covered with the rubber blanket 66. The purpose of this measure has already been explained. The tooth division of the pinions 68 corresponds to the tooth division of the racks 12 so as to guarantee that the engagement between the pinions 68 and the racks 12 has as little free play as possible.

The axial spacing a between the outwardly facing end surfaces of the guide flanges 70 is equal to the spacing b of the edges of the racks 12 which face one another, so that the printing roller when positioned on the racks 12 is held with practically no play in the axial direction.

The roll body has passing through it a roller shaft 72 which, for example, can be made of a tube. The roller shaft 72 extends in the axial direction beyond each end of the roll body 62 and at each end of the roll body extends into a complementary bore 74 of a cylindrical hand grip 76 (FIG. 6). The hand grips 76 can be fastened to the shaft 72 in any desired way, however also obviously the shaft 72 could be made rigid with the roll body 62 and be rotatably journalled in each hand grip 76. The last mentioned embodiment is, however, more complicated. As seen in FIG. 6 the diameter of the hand grip 76 is larger than the diameter of the guide flanges 70. According to FIG. 7 each hand grip 76 further has a flat surface 76 extending parallel to the axis of the roll so that the printing roller 60 after being laid upon a support surface will not roll on it. The radial spacing c of the surfaces 78 from the shaft axis 80 is therefore at least slightly larger than the radius r of the guide flanges 70 so that also after the roller 60 is laid on a supporting surface the roll body 62 can be turned. This facilitates, for example, the cleaning of the rubber blanket.

For making a print, for example a multi-colored print, printing plates for the different colors are prepared in a known way in which case it is to be noticed that the individual printing plates will exactly align with one another on the stationary portions of the printing apparatus if the holes for the pins 28 in the printing plates align with one another.

Then the first printing plate is oriented on the printing plate support 14 by means of the centering bar 22 and is clamped in fixed position. In order to achieve a clamping effect the pins 28 can, if need be, be provided with a circumfertial bead or a slight thickening so that they fit tightly in the associated bores 30 of the printing plate support 14.

Figure 2:
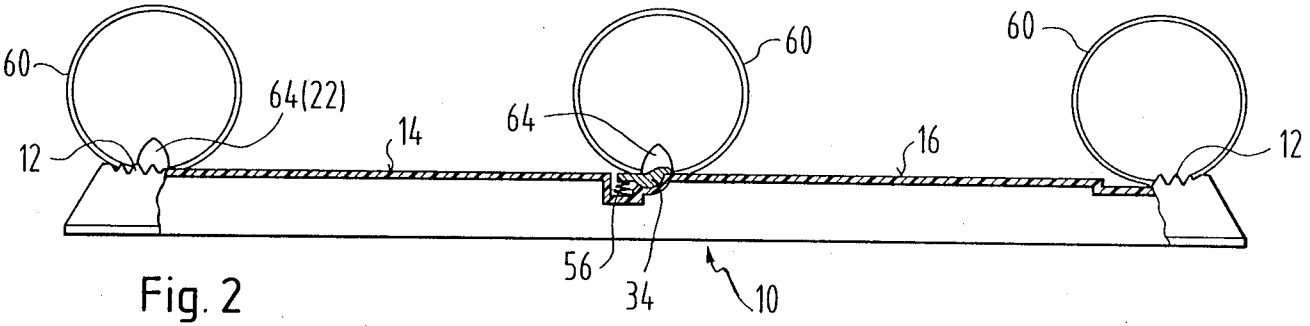
FIG. 2 is a partially broken away side view of the arrangment of FIG. 1 wherein the printing roller is shown in three different positions on the carrier plate.

Subsequently, a printing carrier, for example, a piece of paper or cardboard or the like is oriented on the printing carrier support 16 by means of the abutment 58 and the clamping bar 38 and is fixed in place by the clamping bar 38. Then the printing roller 60 is placed onto the racks 12 at the left end of the carrier plate 10, as shown in FIG. 2, so that the centering bar 28 is received in the groove 64. After the inking of the printing plate 20 the printing roller 60 is rolled over the printing plate 20 with a suitable pressure whereupon the rubber blanket 66 takes on ink from the inked areas of the printing plate 20, so that a negative picture appears on the surface of the rubber blanket. The measurements of the apparatus are so chosen that the roll body 62 after one rotation is positioned with its groove 64 over the clamping bar 34, as illustrated by the middle position of the printing roller 60 in FIG. 2. Thereby an obstuction to the printing roller movement by the clamping bar 34 is avoided. Upon further rolling of the printing roller 60 toward the illustrated right hand end position of FIG. 2 the picture existing on the rubber blanket 66 is transferred to the printing carrier 36. Upon reaching the ends of the racks the printing roller 60 is lifted from the plane of the printing plate and the printing carrier support by a lessening of the depth of the teeth of the racks 12 (see FIG. 2). The roller is then taken from the carrier plate 10 and repositioned on the centering bar 22. It has been shown that with this apparatus and with repeated passes of the printing roller an absolutely sharp print is achieved.

As a rule, next a number of printing carriers 36 corresponding to the desired number of copies is printed with the one color. Subsequently the printing plate is exchanged for another printing plate of another color. Then the printing carriers already printed with the one color are printed in series with the second color and so forth. Despite the simple construction and the simple manipulation of the printing apparatus of the invention it allows the manufacture of faultless sharp-lined multicolored prints.

Figure 12:
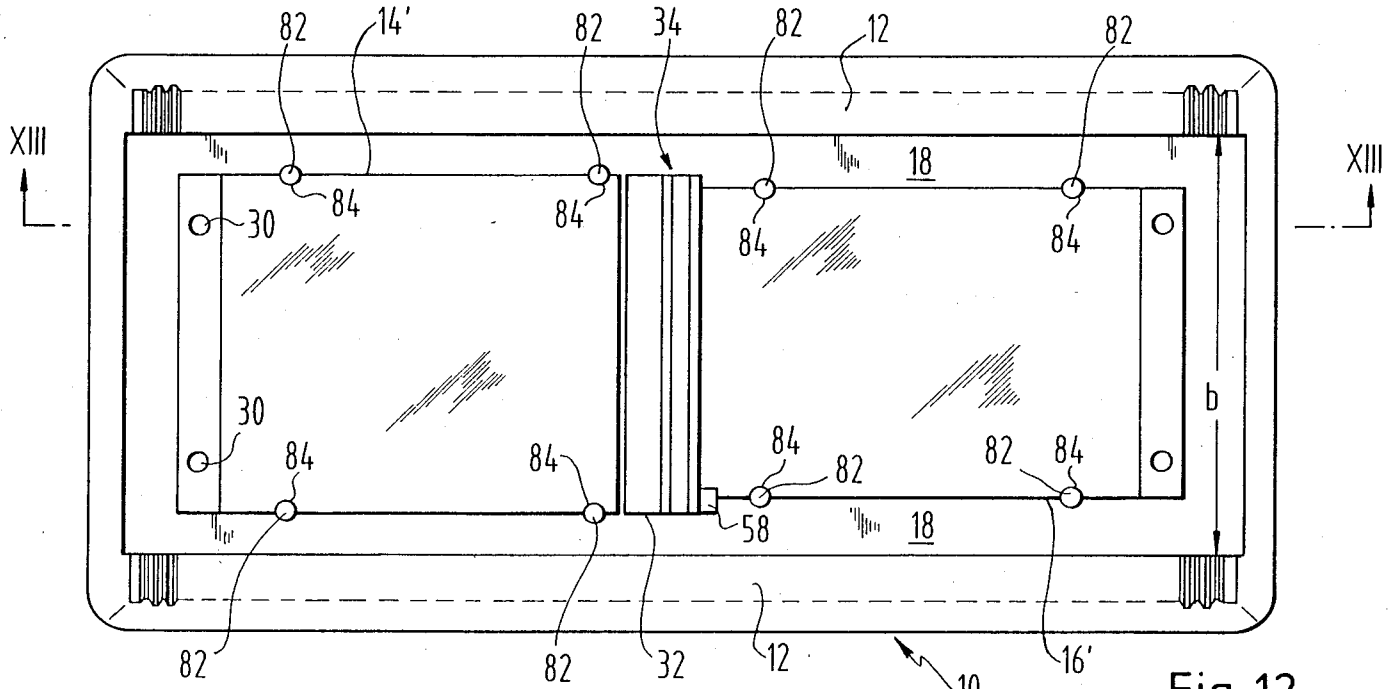
FIG. 12 is a plan view, corresponding to that of FIG. 1, of a second embodiment of the invention.
Figure 13:
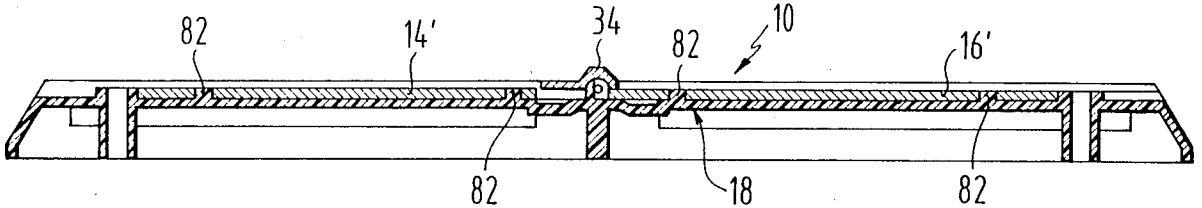
FIG. 13 is a sectional view taken along the line XIII—XIII of FIG. 12.

In the second embodiment of the invention shown in FIGS. 12 and 13 similar parts are again shown with the same reference numbers. The embodiment shown in these Figures differs from the first embodiment shown by FIGS. 1 through 11 solely in that the printing plate support 14' and the printing carrier support 16' are formed as flat plates removable from the carrier plate 10, as is well seen in FIG. 13. The position of the two plates 14' and 16' on the carrier plate 10 are determined by pins 82 formed on the carrier plate 10 and received in complementary notches 84 in the edges of the plates 14' and 16' when these plates lie on the carrier plate 10. The pins 82 do not extend above the top surfaces of the plates 14' and 16'. The advantage of this arrangement is that other printing techniques are possible beyond off-set printing. For example, instead of the printing plate support 14', a linoleum cut, which can be made positive reading as other high, flat and deep printing blocks, can be placed on the carrier plate 10. The resulting print because of the indirect print transfer is positive reading. Further after the removal of the printing carrier support 16' printing carriers thicker than the usual paper can be supported. The illustrated embodiment of FIGS. 12 and 13 is for these reasons more versatile than the first embodiment, yet at the same time it retains for off-set and multi-colored printing the required precision.

I claim:

1. Printing apparatus comprising a carrier plate having a pair of spaced parallel racks extending in a printing direction and also having a flat printing plate support and a flat printing carrier support located behind the printing plate support in said printing direction, both of which supports are located between said two racks, a printing roller cooperable with said carrier plate and freely removable therefrom, said printing roller being covered with a rubber blanket and having a pinion on each of its ends for engagement with an associated one of said racks, said printing roller having hand grips at its opposite ends and being freely rotatable relative to said hand grips, a centering bar extending perpendicular to said printing direction and located on said carrier plate at the front of said printing plate support in said printing direction, said printing roller having a centering groove complementary to said centering bar extending parallel to its axis which engages said centering bar at the starting position of said printing roller, said centering bar being removable from said carrier plate and fastenable to said carrier plate by means of at least two pins which are insertable through complementary holes in a printing plate to hold such printing plate on said printing plate support in a fixed position relative to said printing plate support, a clamping bar on said carrier plate located between said printing plate support and said printing carrier support and oriented perpendicular to said printing direction for fixedly holding a printing carrier to said printing carrier support, said clamping bar being supported on said carrier plate for pivotal movement about an axis extending perpendicular to said printing direction between a clamping position and releasing position with respect to a printing carrier supported on said printing carrier support, means biasing said clamping bar toward said clamping position, said clamping bar having an upper portion which extends upwardly beyond said printing carrier support, the spacing of said clamping bar as measured in the printing direction from said centering bar being equal to the circumference of said printing roller and the width of said upper portion of said clamping bar as measured in said printing direction being smaller than the width of said centering groove in said printing roller so that as said printing roller moves over said clamping bar said upper portion of said clamping bar is freely received in said centering groove without interfering with the movement of said roller in said printing direction, said clamping bar being engageable with one end of a printing carrier received on said printing carrier support to position such printing carrier relative to said printing carrier support in the direction parallel to said printing direction, and a stop on said carrier plate in the form of an upwardly extending projection located along one side edge of said printing carrier support, said projection being engageable with a side edge of a printing carrier received on said printing carrier support to position such printing carrier relative to said printing carrier support in the direction perpendicular to said printing direction.

2. Printing apparatus according to claim 1 further characterized in that said printing plate support, said printing carrier support and said racks are made of one piece with said carrier plate.

3. Printing apparatus according to claim 1 further characterized in that said printing plate support and said printing carrier support are formed as plates removable from said carrier plate, and means for positioning each of said removable plates relative to said carrier plate.

4. Printing apparatus according to claim 3 further characterized in that said carrier plate and said removable plates have complementary projections and recesses to allow the substitution of different removable plates on said carrier plate.

5. Printing apparatus according to claim 1 further characterized in that said carrier plate, said printing plate support, said printing carrier support and said racks are all made of plastic.

6. Printing apparatus according to claim 1 further characterized in that the diameter and the spacing of said two pins associated with said centering bar correspond to the diameter and the spacing of the usual punches used for office purposes.

7. Printing apparatus according to claim 1 further characterized by said centering bar having a cross section of at least nearly triangular shape with one flat side for being supported adjacent said carrier plate and two convexly curved flanks.

8. Printing apparatus according to claim 1 further characterized in that said printing roller axially inwardly of each of its pinions has a guide flange extending radially beyond the pinion.

9. Printing apparatus according to claim 8 further characterized in that each of said hand grips has a larger diameter than said guide flange and along its circumference has at least one flat surface parallel to the axis of said roller the radial spacing of which flat surface from the roller axis is larger than the radius of said guide flange.

10. Printing apparatus according to claim 1 further characterized in that said racks are so designed that the movement path of the printing roller in the printing direction continuously rises in the end sections of the racks which extend beyond said printing carrier support.

11. Printing apparatus according to claim 1 further characterized in that the crown circle diameter of said pinions is slightly larger than the outer diameter of said printing roller as covered with said rubber blanket.

* * * * *